US005116246A

United States Patent [19]

Perry et al.

[11] Patent Number: 5,116,246

[45] Date of Patent: May 26, 1992

[54] FUSE BLOCK ADAPTERS FOR TERMINAL BLOCKS

[76] Inventors: Jeffrey E. Perry, 22 Marlborough Road, Guelph, Ontario, Canada, N1E 3X2; Harry Barber, R.R. #2, Elora, Ontario, Canada, N0B 1S0

[21] Appl. No.: 654,810

[22] Filed: Feb. 12, 1991

[51] Int. Cl.[5] ..... H01R 13/68

[52] U.S. Cl. ..... 439/621; 337/209; 439/709

[58] Field of Search ..... 439/621, 622, 709; 337/209, 213-215

[56] References Cited

U.S. PATENT DOCUMENTS

| | | | |
|---|---|---|---|
| 3,354,356 | 11/1967 | Pettit et al. | 317/116 |
| 3,418,615 | 12/1968 | Canney | 337/215 X |
| 3,435,291 | 3/1969 | Paulus | 317/15 |
| 3,479,563 | 11/1969 | Roy | 317/15 |
| 3,516,040 | 6/1970 | Ripley et al. | 336/96 |
| 3,691,425 | 9/1972 | Weyrich et al. | 317/15 |
| 4,112,405 | 9/1978 | Joseph | 337/4 |
| 4,132,913 | 1/1979 | Lautner et al. | 310/68 |
| 4,363,014 | 12/1982 | Leach et al. | 336/90 |
| 4,503,413 | 3/1985 | Stalzer | 336/192 |
| 4,539,541 | 9/1985 | Bharteey et al. | 335/132 |
| 4,767,339 | 8/1988 | Comerci | 439/716 |
| 4,804,340 | 2/1989 | Hamer et al. | 439/709 |
| 4,810,991 | 3/1989 | Olesak et al. | 336/96 |

*Primary Examiner*—Eugene F. Desmond

[57] ABSTRACT

Adapter for securing a terminal block, such as the standard terminal block on a transformer, to one or more standard fuse blocks, requiring a minimum of parts and mounting space. An adapter plate is interposed between the terminal block and the bottom of the fuse block and secured to each. In one embodiment, the conventional terminal screws of the terminal block are used to secure the adapter to the terminal block. In the illustrated embodiments, the adapter plate does not provide any electrical connection between the fuse block and terminal block, this being provided by jumper wires having their respective wire terminals secured to terminals of a joined terminal block and fuse block.

12 Claims, 2 Drawing Sheets

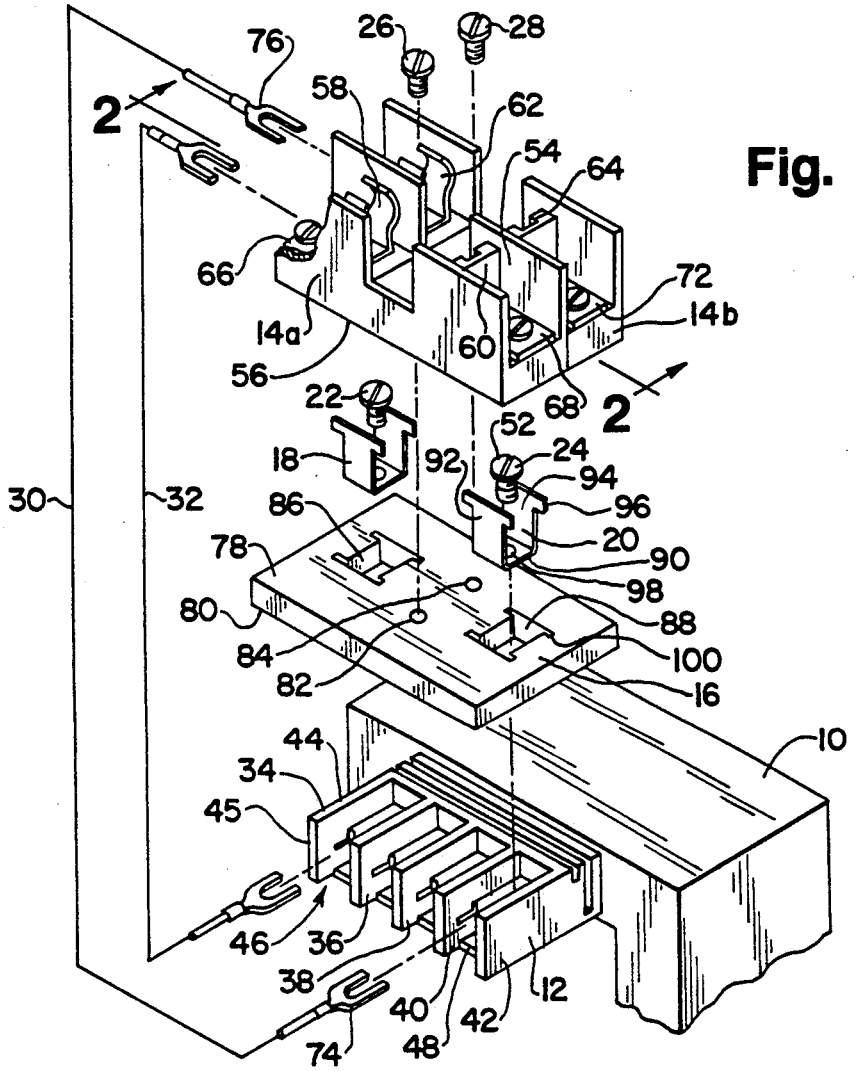
Fig. 1
Fig. 2
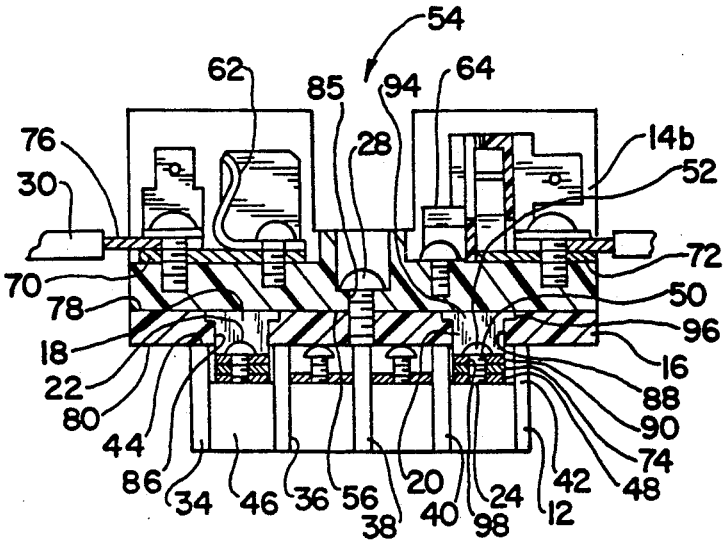

FUSE BLOCK ADAPTERS FOR TERMINAL BLOCKS

BACKGROUND OF THE INVENTION

The invention relates generally to the combination of a fuse block and a terminal block for electrical apparatus, and more particularly to apparatus for joining a conventional fuse block to a conventional terminal block to form such a combination.

The combination of a terminal block, a fuse block, and a transformer is known. One advantage of this combination is that the terminal and fuse blocks can be supported on the transformer above its mounting plate. Thus, separate places need not be provided on a circuit board for a transformer, a terminal block, and a fuse block.

Prior combinations of fuse blocks and terminal blocks have been specially fabricated, low-volume parts, since the number and types of fuses and terminals used with a transformer vary. Thus, such combinations have the disadvantage of being expensive. Individual transformers, fuse blocks, terminal blocks, and transformer/terminal block combinations, on the other hand, have been standardized and are mass manufactured at low cost. Thus, it would be desirable to install one or more standard fuse blocks on a standard terminal block in an economical manner.

Another disadvantage of specially fabricated fuse block/terminal block assemblies is their lack of flexibility. A circuit manufacturer who uses terminal blocks and fuse blocks in several types of apparatus must either keep separate inventories of each specially fabricated fuse block/terminal block assembly or lose the advantages of using such assemblies. Neither choice is desirable.

Customers may also want to modify or repair a preexisting circuit containing a transformer and terminal block by adding a fuse block or replacing an existing fuse block. Many existing devices cannot be modified or repaired in this manner.

One particular transformer and terminal block assembly which could desirably be supplemented by a fuse block is shown in U.S. Pat. No. 4,804,340, issued to Hamer, et al. on Feb. 14, 1989. This patent is hereby incorporated by reference in its entirety herein to show a transformer and terminal block assembly for use with the present invention.

OBJECTS OF THE INVENTION

Thus, a general object of the present invention is to provide a fuse block which is itself standardized, and which mounts on a standard terminal block.

A more specific object of the invention is an adapter which can be interposed between a standard fuse block and a standard terminal block to join them together.

Other objects of the invention are to provide an inexpensive adapter and to allow a new or different fuse block to be installed on an existing terminal block.

Still another object is to allow a fuse block to be installed on a terminal block without reworking the terminal block or the fuse block.

Yet another object of the invention is to provide an adapter which shields the terminals of the terminal block without impairing access to and use of the terminals.

Additional objects of the invention will be apparent from the present specification, drawings, and claims.

SUMMARY OF THE INVENTION

The present invention is an adapter for mechanically joining a standard terminal block and a standard fuse block. The adapter comprises a plate having opposed sides. Fastening means are provided for attaching one side of the adapter plate to the fuse block. Fastening means are also provided for attaching the other side of the adapter plate to the terminal block, preferably so the adapter plate partially covers the terminals of the terminal block.

One feature of the preferred embodiment is that the usual terminal screws of a standard terminal block can be used to mechanically attach the adapter plate to the terminal block. No electrical connection of the fuse block to the adapter plate or terminal block is required. The separation of mechanical and electrical connections provides the maximum possible flexibility of use.

Another feature of the preferred embodiment is that the fuse blocks can be mounted singly or ganged, using the same adapter.

BRIEF DESCRIPTION OF DRAWINGS

FIG. 1 is an exploded perspective view of a first embodiment of the present invention.

FIG. 2 is a section of the assembled parts of FIG. 1, taken along line 2—2 of FIG. 1.

DETAILED DESCRIPTION OF THE INVENTION

Figure 3:
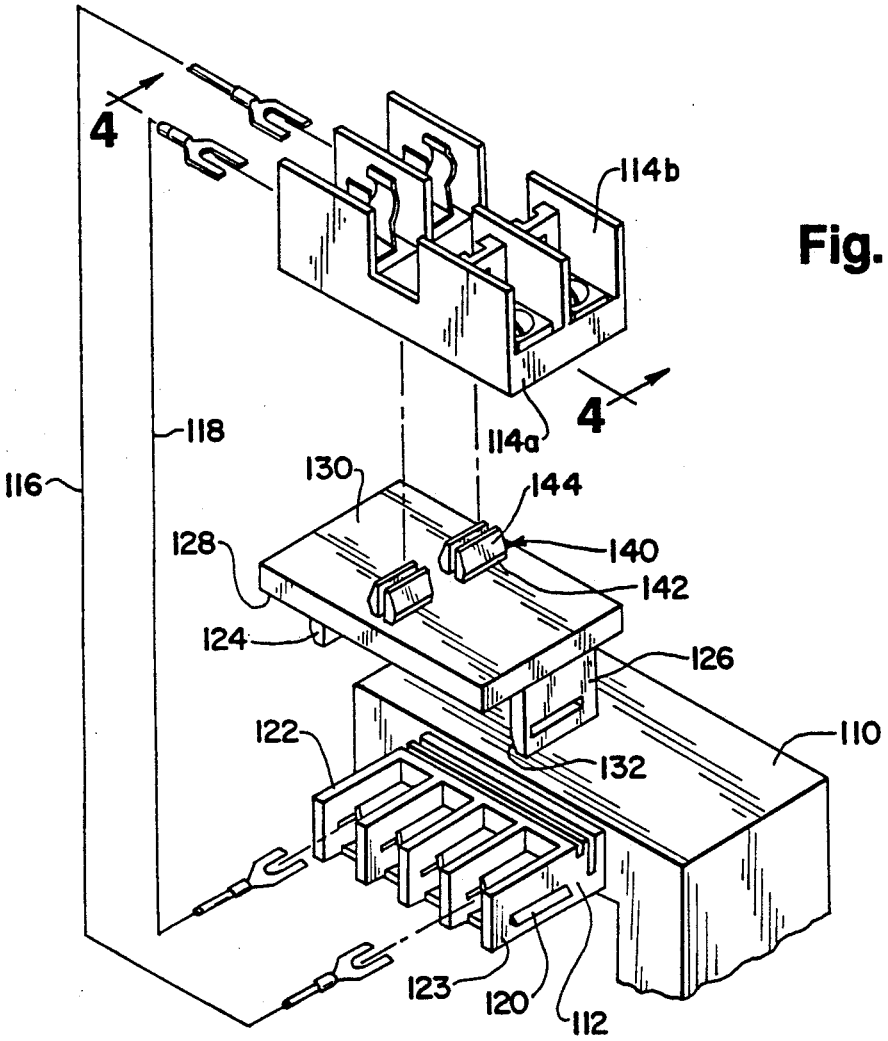
FIG. 3 is an exploded perspective view of a second embodiment of the present invention.

While the invention will be described in connection with certain preferred embodiments, it will be understood that the inventors do not intend to limit the invention to those embodiments. On the contrary, the inventors intend to protect all alternatives, modifications, and equivalents as may be included within the spirit and scope of the invention as defined by the appended claims.

Referring first to FIGS. 1 and 2, the transformer 10 and terminal block 12 are made and joined as described in U.S. Pat. No. 4,804,340, which has been incorporated herein by reference. In FIG. 1, only a single terminal block is shown. However, in the structure shown in the patent incorporated by reference, a terminal block 12 is located on each side of the transformer, one facilitating connections to the input leads and the other facilitating connections to the output leads of the transformer.

The fuse block 14 is a double fuse block, one example of which is a gang of two Littelfuse® Class CC fuse blocks, part L60030C-1PQ, as described in U.S. Pat. No. 4,767,339, issued to Comerci on Aug. 30, 1988. Each fuse holder of the gang is separable from the others. A single fuse block can be used, or two or more single fuse blocks can be ganged together. Here, the single fuse blocks are labeled **14*a* and 14*b***.

The adapter according to the present invention comprises an adapter plate 16, adapter clips 18 and 20, and terminal screws 22 and 24 which are the screws normally used with the terminal block 12 to fasten leads to the terminals. Screws 26 and 28 secure the fuse blocks **14*a* and 14*b* to the adapter plate 16. The jumper wires 30 and 32 are used to make electrical connections between the screw terminals of the terminal block 12 and the fuse block 14**.

The terminal block 12 comprises flanges 34, 36, 38, 40 and 42. Each flange such as 34 has an upper edge 44 and a side edge 45, the coplanar upper edges such as 44 defining an external surface of the terminal block 12. The space between two adjacent flanges such as 40 and 42 defines a terminal bay 46 recessed in the external surface. Typically, an electrical terminal such as the lug 48 is located within each bay, enough bays being provided in one or more terminal blocks to allow separate connections to be made to all the input and output leads of the transformer or other apparatus. Excepting the terminal lugs such as 48, the entire terminal block 12 is typically made of an electrically insulating material, and the terminal lugs such as 48 are recessed sufficiently to prevent casual contact by a person or any apparatus in the vicinity. In this embodiment, each terminal lug such as 48 has an aperture 50 which receives a terminal screw such as 24 having a head such as 52. In the conventional use of a terminal block 12, the head 52 bears against the surface of the lug 48 when no terminal is attached. When a wire terminal is present, it is clamped between the lug 48 and the head 52 to provide a secure mechanical and electrical connection.

The specific features of the fuse block 14 relevant herein are opposed first (or top) and second (or bottom) sides 54 and 56 and fuse engaging means. Here, the fuse-engaging means are the pairs of fuse clips 58, 60 and 62, 64 which receive conventional cartridge fuses and are respectively connected to the fuse terminals 66, 68, 70, and 72. Typically, one terminal of each fuse is connected to a terminal of the block 12, and the other terminal of the same fuse is left open to allow a connection to an external circuit. Thus, the fuse terminals 66–72 serve as the terminals of the assembly. To make the necessary electrical connections between the terminal block 12 and the fuse block 14, the jumper wire 30 has a wire terminal 74 received by and clamped between the head 52 and lug 48 and a wire terminal 76 for connection to the fuse terminal 66. Similar ends and connections are provided for the jumper wire 32.

Turning in particular to the adapter shown in FIGS. 1 and 2, the adapter plate 16 has opposed first (or top) and second (or bottom) sides 78 and 80, and is made of electrically insulative material in the preferred embodiment. One suitable material is conventional phenolic-impregnated fiber board.

The adapter includes first fastening means for attaching the first side 78 of the adapter plate 16 to the second side 56 of the fuse block 14. In this embodiment, the first fastening means comprises apertures 82 and 84 of the adapter plate 16 which receive the self-tapping screws 26 and 28. The shafts of the screws 26 and 28 are passed through the mounting holes such as 85 of the fuse blocks **14*a* and 14*b*. Since disassembling the ganged blocks 14*a* and 14*b* requires one of the fuse blocks to be slid vertically with respect to the other fuse block, and since both fuse blocks are mounted on a common surface (the first side 78**), a single mounting screw for each fuse block is sufficient to prevent the fuse blocks from pivoting.

The adapter plate 16 is secured to the terminal block 12 using second fastening means. The second fastening means comprises the apertures 86 and 88, adapter clips 18 and 20, and terminal screws 22 and 24. Each clip such as 20 is generally U-shaped, comprising a bight portion 90 and upstanding legs 92 and 94, each leg such as 94 terminating in a pair of ears such as 96. Each adapter clip such as 20 also has an aperture such as 98 to pass the threaded shaft of the terminal screw such as 24.

Each aperture such as 88 allows the bight portion 90 to drop through the adapter plate 16. Each aperture such as 88 includes two pairs of partial depth slots such as 100, each about as deep as the ears 96. The slots 100 receive the ears 96, so the tops of the legs 92 and 94 are substantially flush with the first side 78 of the adapter plate 16 and can drop no further. When the fuse block 14 is attached to the first side 78 by the fuse block screws 26 and 28, the adapter clips 18 and 20 are captured by the second side 56 of the fuse block 14. The separation between the ears such as 96 and the bight portion 90 of each adapter clip such as 18 is such that the bottom of the bight portion rests slightly above the terminal lug such as 48 when the assembly of FIG. 1 is put together.

The apparatus is assembled as follows. First, all the wire terminals such as 74 are led to the appropriate terminal lugs such as 48 of the terminal block 12. The terminal screws 22 and 24 which are to be used for attaching the adapter are removed from the terminal lugs such as 48 at this point. The terminal screws which are not used for attaching the adapter are advanced to clamp the corresponding wire terminals in place.

The adapter clips 18 and 20 are inserted in the apertures 86 and 88, and the adapter plate 16 is placed so its second side 80 abuts the external surface defined by the upper edges such as 44 of the terminal block 12. The bight portions such as 90 of the adapter clips such as 20 bear against the wire terminals such as 74. When a terminal screw such as 24 is installed and tightened, its head 52 bears against the margin of the bight portion 90 outside the aperture 98. The wire terminals such as 74 received by the terminal lugs such as 48 are clamped between the surface of the terminal lug such as 48 and the bight portion such as 90.

Before or after the terminal block 12, fuse block 14, adapter plate 16, and associated parts are assembled as just described, the wire terminals such as 76 of the jumper wires such as 30 are connected in the usual manner to the fuse terminals such as 70. The electrical connections between the terminals (such as the lug 48) of the terminal block 12 and the corresponding terminals (such as 70) of the fuse block 14 are thus completed. The mounting of the terminal block on a transformer can be carried out conventionally or according to U.S. Pat. No. 4,804,340, issued to Hamer et al., incorporated by reference previously. The installation of the transformer on the chassis or circuit board of an electrical or electronic apparatus, the connection of the remaining terminals of the fuse block to such apparatus, and the circuit comprising a transformer, fuses, and other apparatus may be conventional.

The clips 18 and 20 could be made of an insulating material within the scope of the invention. However, for ease of fabrication and durability, and to provide the best possible connection between the wire terminals such as 74 and terminal lugs such as 48, the clips are desirably made of electrically conductive metal.

The fuse block screws 26 and 28 are used to attach the fuse block 14 to the apertures 82 and 84 of the adapter plate 16. Electrical leads such as the jumper wires 30 and 32 already connected to the desired terminals of the terminal block 12 may then be attached to the desired terminals of the fuse block 14.

While securing the jumper wires 30 and 32 represents an extra step in assembling the present combination, the use of jumper wires provides extra flexibility in the provision of electrical connections between a standard fuse block and a standard terminal block. There is no need to electrically connect any particular terminal of the block 12 to a particular fuse terminal. The adapter plate 16 can be narrower to accommodate a single fuse block such as 14*a* or wider to accommodate three or more fuse blocks within the scope of the present invention.

Figure 4:
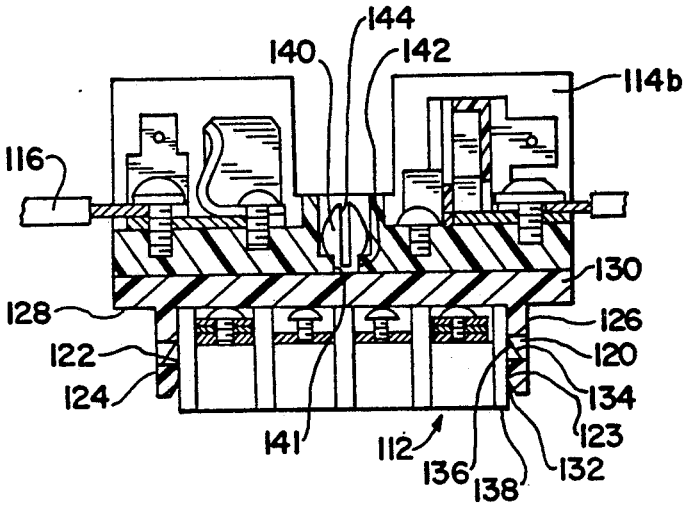
FIG. 4 is a section of the assembled parts of FIG. 3, taken along line 4—4 of FIG. 3.

Referring now to FIGS. 3 and 4, a second embodiment of the invention will be described. In this embodiment, the transformer 110, terminal block 112, fuse blocks 114*a* and 114*b*, and jumper wires 116 and 118 correspond to their counterparts in the first embodiment, except that in this embodiment the terminal block 112 has lugs such as 120 on its opposed side faces 122 and 123 which are engaged by the fingers 124, 126 extending perpendicularly from the second surface 128 of the adapter plate 130.

The fingers such as 126 and the lugs such as 120 have complementary bevelled surfaces 132 and 134, and the fingers 124 and 126 are made of resilient material. Thus, the fingers 124 and 126 are displaced outward as the adapter plate 130 is pushed down and the surfaces 132 and 134 engage each other. When the lugs such as 120 are registered with the slots such as 136 of the fingers such as 126, the lugs such as 120 are received in the slots such as 136 and the fingers 124 and 126 snap against the side faces 122 and 123. In this embodiment, it is easier to snap the adapter plate 130 onto the terminal block 112 than to remove it, since the lower faces of the lugs 120 are not bevelled. The fingers 124 and 126 can be pried apart, however, to disengage the slots 136 from the lugs 120.

By a slight modification of structure the lugs 120 (which represent a modification of a standard terminal block 112) would not be necessary. The fingers 124 and 126 could be provided with inward barbs at their lower ends which would be received under the lower edges such as 138 of the faces such as 123.

To attach the fuse blocks 114*a* and 114*b* to the adapter plate 130, the fuse block screws 26, 28 and apertures 82 and 84 of the first embodiment are replaced by split stakes such as 140, each having a neck 142 sized to pass through a corresponding aperture 143 of a fuse block such as 114*a* (which will accept either a stake or a screw), and upper ends 144 which are barbed and resilient. The upper ends 144 are urged together when their respective beveled upper surfaces bear against the margin of the aperture 143 of the fuse block 114*b* and spring apart when they emerge from the aperture 143, locking the barbs over the margins of the aperture 143. A particular advantage of the structure of FIGS. 3 and 4 is that the adapter plate 130 can be a single molded plastic part.

Thus, apparatus has been shown for physically mounting one or more fuse blocks on a terminal block, each of which can be a standard part. The adapter can be inexpensive and can allow a first or additional fuse block to be installed on an existing terminal block in a circuit. The adapter plates 16 and 130 also shield the terminals of the terminal blocks, 12 and 112, from the environment without impairing access to or use of the terminals. Thus, one or more of the objects of the present invention are realized.

What is claimed is:

1. An adapter for mechanically joining a terminal block and a fuse block;

the terminal block having at least one external surface, at least one bay recessed in the external surface, and a bay terminal within the bay;

the fuse block comprising opposed first and second sides, fuse engaging means for engaging and carrying at least one fuse fastened to the first side, and fuse terminals for providing electrical contact points with the fuse;

said adapter being independent of fuse engaging and contacting means, for interposition between said terminal block and said fuse block and mounting said fuse block on said terminal block, and comprising a mounting plate member having opposed first and second sides; first fastening means for attaching the first side of said plate member to the fuse block second side; and second fastening means for attaching the second side of said plate member to the terminal block adjacent to the external surface thereof.

2. The adapter of claim 1, wherein said plate member is made of an electrically insulative material.

3. An adapter for mechanically joining a terminal block and a fuse block;

the terminal block having at least one external surface, at least one bay recessed in the external surface, and a bay terminal within the bay; wherein the terminal block includes a terminal screw having a head adapted for being threadably advanced substantially against said bay terminal for normally clamping a wire terminal to the bay terminal;

the fuse block comprising opposed first and second sides, fuse engaging means fastened to the first side, and fuse terminals;

said adapter comprising a plate having opposed first and second sides; first fastening means for attaching the first side of said plate to the fuse block second side; and second fastening means for attaching the second side of said plate to the terminal block adjacent to the external surface thereof; said second fastening means comprising:

an aperture through the plate of said adapter;

a member received in said aperture and having a first portion projecting from the second side of said adapter plate, received in the bay, and adapted to be clamped between the head of the screw and the bay terminal;

said member having a second portion for capturing the plate of said adapter adjacent to the external surface of the terminal block when said first portion is so clamped.

4. The adapter of claim 3, wherein the second portion of said member has an aperture sized to pass the shaft of the terminal screw and a margin about said aperture which receives the head of the terminal screw.

5. The adapter of claim 3, wherein said member is a generally U-shaped clip, the first portion of said member is a bight portion of said clip received adjacent to a bay terminal, said member further comprises legs upstanding from said bight portion and adapted to extend through said external surface of said terminal block, and the second portion of said member comprises ears at the upper extremities of said legs for capturing said adapter plate when said member is secured to the bay terminal by the terminal screw.

6. The adapter of claim 5, wherein said clip is made of electrically conductive material.

7. The adapter of claim 6, wherein said clip is electrically isolated from the fuse terminals.

8. The adapter of claim 6, wherein said clip and the bay terminal are adapted to clamp a wire terminal inserted between them when said terminal screw is advanced.

9. The adapter of claim 8, wherein said adapter further comprises a jumper wire having a wire terminal at one end adapted to engage a bay terminal and means at the other end to engage a fuse terminal.

10. An adapter for mechanically joining a terminal block and a fuse block;

the terminal block having at least one external surface, at least one bay recessed in the external surface; and a bay terminal within the bay; wherein the terminal block includes opposed walls perpendicular to its external surface;

the fuse block comprising opposed first and second sides, fuse engaging means fastened to the first side, and fuse terminals;

said adapter comprising a plate having opposed first and second sides; first fastening means for attaching the first side of said plate to the fuse block second side; and second fastening means for attaching the second side of said plate to the terminal block adjacent to the external surface thereof, said second fastening means comprising at least two fingers extending perpendicularly from the second surface of the plate of said adapter for engaging the opposed walls of the terminal block for securing the terminal block.

11. An adapter for mechanically joining a terminal block and a fuse block;

the terminal block having at least one external surface, at least one bay recessed in the external surface, and a bay terminal within the bay;

the fuse block comprising opposed first and second sides, fuse engaging means fastened to the first side, and fuse terminals, the second side of the fuse block having an aperture;

said adapter comprising a plate having opposed first and second sides; first fastening means for attaching the first side of said plate to the fuse block second side; said first fastening means comprising a stake extending perpendicularly from the first surface of the plate of said adapter and engageable with said aperture; and second fastening means for attaching the second side of said plate to the terminal block adjacent to the external surface thereof.

12. An adapter for mechanically joining a terminal block and a fuse block;

the terminal block having at least one external surface, at least one bay recessed in the external surface, and a bay terminal within the bay; wherein the terminal block includes a terminal screw having a head adapted for being threadably advanced substantially against the bay terminal for normally clamping a conductor between the screw head and the bay terminal in electrically contacting relation with the bay terminal;

the fuse block comprising opposed first and second sides, fuse engaging means fastened to the first side, and fuse terminals;

said adapter comprising a plate having opposed first and second sides; first fastening means for attaching the first side of said plate to the fuse block second side; and second fastening means for attaching the second side of said plate to the terminal block adjacent to the external surface thereof; and said adapter further comprising a jumper wire having a first wire terminal at one end adapted for being received at a bay terminal and a second wire terminal at the other end to engage a fuse terminal.

* * * * *

UNITED STATES PATENT AND TRADEMARK OFFICE

CERTIFICATE OF CORRECTION

PATENT NO. : 5,116,246

DATED : May 26, 1992

INVENTOR(S) : Jeffrey E. Perry and Harry Barber

It is certified that error appears in the above-indentified patent and that said Letters Patent is hereby corrected as shown below:

In the last line of claim 10, i.e. Col. 7, line 33, insert -- plate to the -- before "terminal block".

Signed and Sealed this

Eighth Day of October, 1996

Bruce Lehman

*Attest:*

BRUCE LEHMAN

*Attesting Officer*

*Commissioner of Patents and Trademarks*